US005273110A

United States Patent [19]

Fitzgibbon, Jr.

[11] Patent Number: 5,273,110

[45] Date of Patent: Dec. 28, 1993

[54] INFLATABLE DEVICES FOR SUSPENDING EXPLOSIVES AND STEMMING MATERIALS IN BOREHOLES

[76] Inventor: Daniel F. Fitzgibbon, Jr., Rte. 3, Van Dyke Mill Rd., Taylorsville, Ky. 40071

[21] Appl. No.: 916,724

[22] Filed: Jul. 22, 1992

[51] Int. Cl.[5] ..... E21B 33/127

[52] U.S. Cl. ..... 166/187; 166/192; 102/333

[58] Field of Search ..... 166/187, 179, 192; 102/304, 311, 312, 313, 333; 138/93; 277/34

[56] References Cited

U.S. PATENT DOCUMENTS

| | | | |
|---|---|---|---|
| 4,660,644 | 4/1987 | Egnor | 166/192 X |
| 4,892,144 | 1/1990 | Coone | 166/187 X |
| 4,913,233 | 4/1990 | Fitzgibbon, Jr. | 166/187 X |
| 4,919,203 | 4/1990 | Fitzgibbon, Jr. | 166/187 |
| 5,000,261 | 3/1991 | Fitzgibbon, Jr. | 166/187 |
| 5,035,286 | 7/1991 | Fitzgibbon, Jr. | 166/187 |

*Primary Examiner*—William P. Neuder
*Attorney, Agent, or Firm*—Kenneth E. Darnell

[57] ABSTRACT

Inflatable devices configured for use particularly in large diameter boreholes and in blasting applications such as vertical cratering, the invention finds utility in blast removal of earth formations wherein the inflatable devices act to suspend explosives and/or stemming materials and the like within a borehole prior to detonation of explosives within said borehole. The inflatable devices are of various shapes and comprise an inner, relatively stretchable inflatable bag enclosed by an outer, relatively non-resilient bag, the inner bag having a valve to allow a fluid such as air to be pumped thereinto with the inner bag expanding to contact inner walls of the outer bag and force the outer bag into contact with walls of the borehole to exert forces against the borehole walls and thus "plug" the borehole at a desired location along the length thereof. Explosive materials and/or stemming materials can thus be suspended at desired locations within the borehole.

22 Claims, 1 Drawing Sheet

INFLATABLE DEVICES FOR SUSPENDING EXPLOSIVES AND STEMMING MATERIALS IN BOREHOLES

CROSS-REFERENCE TO RELATED PATENTS

The present application relates to U.S. Letters Pat. No. 4,913,233, issued Apr. 3, 1990; 4,919,203, issued Apr. 24, 1990; 5,000,261, issued Mar. 19, 1991; and 5,035,286, issued Jul. 30, 1991, all of these patents having the same inventive entity as the present application, the disclosures of these patents being incorporated hereinto by reference.

BACKGROUND OF THE INVENTION

1. Field of the Invention

The invention relates generally to the shattering of earth formations and earth formation removal by the detonation of explosives within boreholes formed in the earth formations. The invention specifically relates to inflatable devices used to support explosives and/or stemming materials within a borehole and which are capable of use in large diameter boreholes such as boreholes having a diameter of up to approximately 48 inches and also in particular blasting techniques such as vertical cratering.

2. Description of the Prior Art

The improvement of various mining and earth removal operations has been fully disclosed by Fitzgibbon, Jr. in U.S. Pat. Nos. 4,913,233; 4,919,203; 5,000,261 and 5,035,286, the disclosures of which are incorporated hereinto by reference. Reference to the Fitzgibbon patents provides a full description of the prior art relative to practices known as "presplitting", that is, shattering of earth formations in a controllable manner prior to the use of techniques generally referred to as "production" blasting. In both presplitting and production operations, explosives and/or stemming materials are suspended within boreholes with detonation occurring according to established practices. The inflatable devices and methods disclosed for their use such as are disclosed in the Fitzgibbon patents are of substantial utility in the art since they are of simple and inexpensive construction yet are capable of supporting explosives and/or stemming in boreholes of widely varying diameter. The art is hereby improved by inflatable devices configured for use particularly in large diameter boreholes and in blasting applications such as vertical cratering. Even in boreholes having diameters of up to approximately 48 inches, the present inflatable devices exhibit improved ability to suspend explosives and/or stemming materials at desired locations within boreholes. The present inflatable devices thus constitute a significant and substantial advance in the art.

SUMMARY OF THE INVENTION

The invention provides particular embodiments of inflatable devices disposable within boreholes formed in earth formations, the boreholes with which the embodiments of the invention are of particular use being vertical or substantially vertical in orientation with the inflatable devices of the invention acting to suspend explosive and/or stemming materials within said borehole to allow practice of the methods for shattering the earth formations to effect presplitting or for causing earth removal from the earth formations inter alia. Inflatable devices of the invention are positioned within boreholes in a deflated condition and are subsequently inflated at the desired location within the borehole to seal or "plug" the hole for support of explosive columns and/or stemming columns. The inflatable devices are formed as a "bag within a bag", that is, an inner first bag formed of relatively resilient and stretchable material is disposed within an outer bag formed of a material which is relatively less resilient. The inner bag is provided with an inflation valve which extends through the outer bag and allows the inner bag to be inflated. The inner bag thus expands on inflation and contacts the inner walls of the outer bag and forces the outer bag into contact with walls of the borehole to thereby exert forces against the borehole walls and thus to "plug" the borehole at a desired location along the length thereof.

According to the invention, the inner bag of the present inflatable devices is preferably formed of any of a variety of flexible polymeric materials including polyvinylchlorides, low density polyethylenes and polyurethane films in selected thicknesses as are described in the aforementioned Fitzgibbon patents, the disclosures of which are incorporated hereinto by reference. In essence, the material forming the inner bag of the present inflatable devices must have the capability to stretch to a degree sufficient to cause the inflatable device to be firm within the borehole when the inner bag has stretched to the degree sufficient to force the relatively nonstretchable outer bag against inner walls of the borehole. The provision of the outer bag prevents undesirable stretching of the inner bag due to formation of the outer bag from a relatively nonstretchable material preferably comprises a woven polyester. It is to be understood that nonwoven material stock can be used as well as materials other than polyester. The present devices are particularly useful in large boreholes, that is, boreholes typically greater than 24 inches and up to approximately 48 inches and greater in borehole diameter. In earth removal operations, use of the present inflatable devices particularly act to cause the devices to be firm within the borehole and to resist continued stretching, particularly in directions along the longitudinal axis of the borehole.

The inflatable devices of the invention can be formed in differing sizes and shape to accommodate boreholes of differing diameter. A shape of a preferred embodiment for the inner and outer bags is a substantially rectangular shape typically formed from a single sheet of polymeric material folded in half and sealed about the resulting edges. For the inner bag, a single sheet of polymeric material such as polyurethane is preferred. For the outer bag, a less resilient and less stretchable polyester material, particularly one of woven polyester material, is preferred. When using the "bag within a bag" structure of the present inflatable devices, the polyurethane inner bag can be formed of a less thick material stock such as approximately 12 to 14 mils while exhibiting the ability to contain twice the pressure on borehole walls. In those situations involving the use of boreholes of up to 48 inches in diameter and the like, it is to be understood that explosive or stemming columns can weigh up to 15,000 pounds or more, it therefore being necessary for an inflatable device intended to plug the borehole to exert as great a force against walls of the borehole as possible.

The inflatable devices of the invention can be used in the practice of a variety of presplitting and earth removal or blasting methods to support explosives and/or stemming materials. The present devices act to maximize the efficiency of the explosive used in both presplitting and production blasting. In many situations, the inflatable devices of the invention are of substantial utility when used to support a stemming column at or near the top of the borehole, the stemming column acting to contain energy on detonation of explosives within the borehole, thereby gaining maximum benefit from the energy of the explosion. The present inflatable devices allow the suspension of explosive and/or stemming columns within larger diameter holes in various blasting and earth removal operations since said devices are capable of supporting heavier columns, particularly stemming columns occasioned by the use of larger diameter holes. The present devices can be used in production blasting even though separate presplitting methods are not employed.

Accordingly, it is an object of the present invention to provide inflatable devices useful in the removal of earth formations by blasting, the inflatable devices being formed as bag within a bag configurations with an inner bag being relatively stretchable and an outer bag being less stretchable in order to increase the ability of the present inflatable devices to suspend explosive and/or stemming columns within boreholes of relatively large diameters. It is a further object of the invention to provide inflatable devices for use in vertical cratering retreat mining techniques wherein the present inflatable devices can be utilized either in uphole or downhole loading of boreholes.

Further objects and advantages of the invention will become more readily apparent in light of the following detailed description of the preferred embodiments.

DESCRIPTION OF THE PREFERRED EMBODIMENTS

Figure 1:
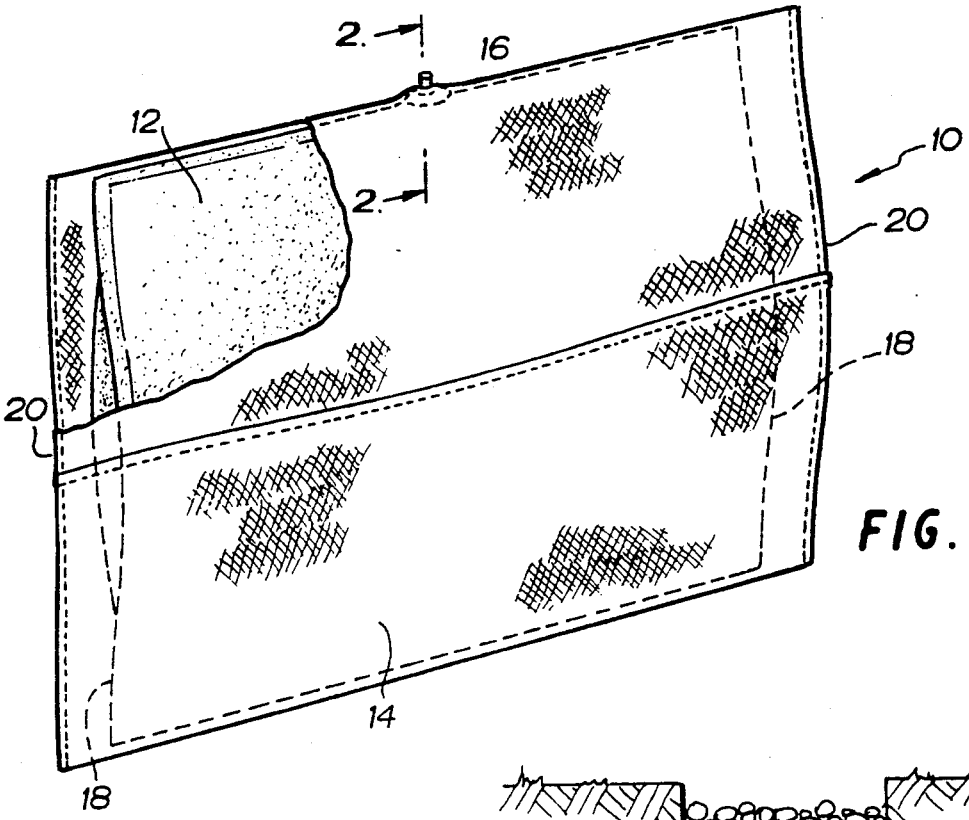
FIG. 1 is an idealized perspective view of an inflatable device according to the invention with a portion cut away to better illustrate the structure of the invention.
Figure 2:
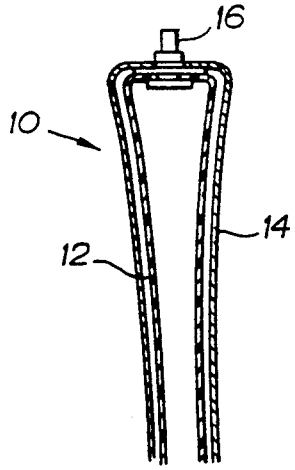
FIG. 2 is a detailed cross-section along lines 2—2 of FIG. 1.

Referring now to the drawings, a preferred inflatable device configured according to the invention is seen at 10 to comprise an inner bag 12 and an outer bag 14, both bags 12 and 14 having a substantially rectangular conformation. The inner bag 12 is substantially received within the outer bag 14, a valve 16 formed in the inner bag 12 being received through the outer bag 14. The inner bag 12 is inflated through the valve 16 through an air line (not shown) connected to a source of inflating gas (not shown).

The inner bag 12 is preferably formed of a polyurethane material having a thickness of approximately 12 to 14 mils although the bag 12 can be formed of other material and of differing thickness. Importantly, the inner bag 12 is formed of a material which is resilient or "stretchable" as is described in the Fitzgibbon patents referred to hereinabove. The inner bag 12 is conveniently formed of a flexible "tube" of the stretchable polymeric material and sealed together at the open ends of the "tube". It will be apparent to those skilled in the art that the inner bag can be otherwise formed, such as from a sheet of polymeric material which is then sealed along three side edges. Further, those skilled in the art will also recognize that the inner bag 12 can be formed of differing shapes such as the disc structures described in the aforesaid Fitzgibbon patents.

The outer bag 14 is preferably formed of a polyester material such as a woven polypropylene. Unwoven polyester materials are also useful, the critical factor being the stretchability of the material from which the outer bag 14 is formed. Essentially, the outer bag 14 exhibits little or no stretchability and is substantially less stretchable than is the material from which the inner bag 12 is formed. The outer bag 14 can also be formed from a "tube" of polyester material which is open at the ends and which is then either sealed together or sewn together to enclose the inner bag 12 therewithin. A portion of the valve 16 extends through the outer bag 14 as shown, it being understood that the valve 16 could be positioned other than as is shown in the drawings.

The inner bag 12 is seen to be of a size such that the outer bag 14 extends an inch or two beyond lateral ends 18 of the inner bag 12. While the bags 12 and 14 can be essentially congruent, it is preferred that "upper" and "lower" edges of the bags 12 and 14 fit essentially flush with each other while the lateral ends 18 of the inner bag 12 and lateral ends 20 of the outer bag 14 be spaced from each other in order to allow a degree of expansion of the inner bag 12 on inflation prior to contact with the outer bag 14 at least in those areas of the inflatable device 10 which contact inner walls of a borehole. The "length" of the device 10 as seen in the drawings is essentially equal to the diameter of the borehole within which the device 10 is disposed. However, it is to be appreciated that a device 10 having a length at least somewhat greater than the diameter of a borehole could be used in that borehole of smaller diameter.

FIG. 1 illustrates the inflatable device 10 with the outer bag 14 being cut away to illustrate a partially inflated inner bag 12, the partial inflation of the inner bag 12 being shown for ease of illustration. The inner bag 12, at least at the lateral ends 18, 20 of the bags 12, 14 expands into contact with the inner walls of the outer bag 14, this initial contact-producing expansion essentially occurring at that point when the inner bag 12 through the outer bag 14 engages inner walls of a borehole (not shown). Continued inflation of the inner bag 12 from that point causes increased pressure against inner walls of the borehole to provide the necessary strength for holding a column of explosive and/or stemming material within the borehole.

Figure 3:
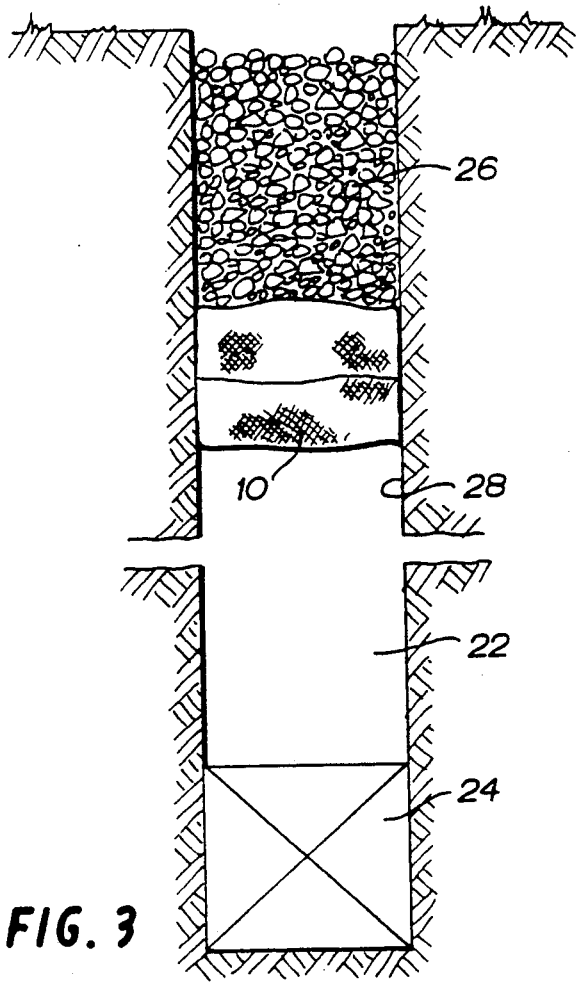
FIG. 3 is an idealized elevational view in partial section of an inflatable device configured according to the invention and disposed within a borehole at a desired location within said borehole, stemming material being suspended by the inflatable device at a desired location along the length of the borehole.

Referring now particularly to FIG. 3, a borehole 22 is seen to contain explosive material 24 at the bottom thereof, the inflatable device 10 being disposed at a desired location within the borehole 22 to suspend a column of stemming material 26. As is seen in FIG. 3, outer walls of the outer bag 14 are forced into contact with inner walls 28 of the borehole 22 by the inflation of the inner bag 22. While the inner bag 22 alone can provide substantial ability to hold explosive and stemming columns of substantial weight within a borehole of typical size, boreholes of larger diameter, typically 10 to 18 inches and even up to 48 inches or more, are best accommodated through use of the inflatable device 10 having the inner bag 12 of substantially stretchable material contained within the outer bag 12 of substantially non-resilient material which is relatively unstretchable.

The inflatable device 10 of the invention thus finds substantial utility when used in large diameter boreholes and in vertical cratering retreat blasting situations and the like.

While the invention has been described relative to particular embodiments of the present inflatable devices and in light of particular methodology, it is to be understood that the invention can be practiced other than as explicitly described herein, the invention being limited only by the recitation of the appended claims.

What is claimed is:

1. A device capable of being inflated in a borehole formed vertically or essentially vertically in the earth prior to initiation of blasting within the borehole, the device acting to suspend a column of stemming material or explosive material within the borehole, comprising:

a first body member formed of a resilient material and which is capable of inflation within the borehole;

a second body member formed of a material which is substantially non-resilient, the second body member containing the first body member; and, valve means carried at least by the first body member for connection to a source of inflating fluid and through which the first body member is filled with said fluid to expand the first body member against inner walls of the second body member, the second body member forcefully engaging walls of the borehole and transferring pressure from said fluid through walls of the first body member to the walls of the borehole, the pressure being adequate to provide an essentially vertical force component directed against the stemming material or explosive material to support and suspend said material at a desired location within the borehole.

2. The device of claim 1 wherein the first body member is formed of opposed planar sheets of a resilient polymeric material sealed together at perimetric edges.

3. The device of claim 2 wherein the planar sheets are rectangular.

4. The device of claim 1 wherein the sheets are formed of a stretchable, polyester-based polyurethane film.

5. The device of claim 1 wherein the valve means comprise a needle valve.

6. The device of claim 1 wherein the first body member and the second body member are substantially rectangular in conformation, the first body member being received substantially fully within the second body member, the second body member being of a greater length and the first body member being disposed within the second body member medially of the length of said second body member.

7. The device of claim 2 wherein the second body member is formed of opposed planar sheets of relatively non-resilient polymeric material joined together at perimetric edges.

8. The device of claim 7 wherein the sheets are formed of a polyester material.

9. The device of claim 8 wherein the sheets are formed of polypropylene.

10. The device of claim 9 wherein the sheets are formed of woven polypropylene.

11. The device of claim 1 wherein the first body member is formed of a resilient polyester-based polyurethane film and the second body member is formed of woven polypropylene.

12. The device of claim 1 wherein the first body member is formed of a resilient polyester-based polyurethane film having a tubular conformation, the first body member being laid flat and sealed at perimetric edges.

13. The device of claim 12 wherein the second body member is formed of a substantially non-resilient polypropylene sheet having a planar conformation, the sheet being folded in half and joined together at free edges to form a bag-like article.

14. The device of claim 1 wherein the first body member is received substantially fully within the second body member.

15. A device capable of being inflated in a borehole prior to initiation of blasting within the borehole, the device acting to support a column of stemming material or explosive material within the borehole, comprising:

a first body member formed of a resilient material and which is capable of inflation within the borehole;

a second body member formed of a material which is substantially non-resilient, the second body member containing the first body member; and, means carried at least by the first body member for inflating said first body member with fluid to expand the first body member against inner walls of the second body member, the second body member forcefully engaging walls of the borehole and transferring pressure from said fluid through walls of the first body member of the walls of the borehole to support the stemming material or explosive material at a desired location within the borehole.

16. The device of claim 16 wherein the first body member is formed of a resilient polyester-based polyurethane film and the second body member is formed of polypropylene.

17. The device of claim 15 wherein the first body member and the second body member are substantially rectangular in conformation, the first body member being received within the second body member, the second body member being of a greater length and the first body member being disposed within the second body member medially of the length of said second body member.

18. The device of claim 15 wherein the first body member is formed of a resilient polyester-based polyurethane film having a tubular conformation, the first body member being laid flat and sealed at open perimetric edges.

19. The device of claim 18 wherein the relatively second body member is formed of a relatively non-resilient polypropylene sheet having a planar conformation, the sheet being folded in half and joined together at free edges to form a bag-like article.

20. The device of claim 19 wherein the sheet is formed of woven polypropylene.

21. The device of claim 15 wherein the first body member is formed of opposed planar sheets of a resilient polymeric material sealed together at perimetric edges.

22. The device of claim 15 wherein the first body member is received substantially fully within the second body member.

* * * * *